US005934014A

United States Patent [19]

Carrothers

[11] Patent Number: 5,934,014

[45] Date of Patent: Aug. 10, 1999

[54] STAND FOR POTTED PLANTS

[76] Inventor: Gerald L. Carrothers, 92067 Sharewater La., Chesire, Oreg. 97419-9704

[21] Appl. No.: 08/988,769

[22] Filed: Dec. 11, 1997

[51] Int. Cl.[6] ..... A47G 7/02; A47G 7/04

[52] U.S. Cl. ..... 47/39; 47/41.01; 248/370

[58] Field of Search ..... 47/39, 41.01, 41.14; 248/127, 146, 153, 176.1, 370

[56] References Cited

U.S. PATENT DOCUMENTS

| | | | |
|---|---|---|---|
| 342,476 | 5/1886 | Swartout | 47/39 |
| 2,794,554 | 6/1957 | Donner | 47/39 |
| 2,861,764 | 11/1958 | Fisher | 47/39 |
| 3,169,742 | 2/1965 | Smith | 248/146 |
| 3,279,733 | 10/1966 | Hannan | 248/153 |
| 4,083,457 | 4/1978 | Dromboski | 211/85.23 |
| 4,194,319 | 3/1980 | Crawford | 47/27 |
| 4,583,323 | 4/1986 | Graves et al. | 47/67 |
| 4,757,641 | 7/1988 | Penrod | 47/39 |
| 4,770,303 | 9/1988 | Boyd | 47/39 |
| 4,942,693 | 7/1990 | Sibold | 47/39 X |
| 4,991,344 | 2/1991 | Carney | 47/39 X |
| 5,037,049 | 8/1991 | Funk | 47/39 X |
| 5,487,476 | 1/1996 | Barfield | 47/39 X |

*Primary Examiner*—Jack W. Lavinder
*Assistant Examiner*—Yvonne R. Abbotl
*Attorney, Agent, or Firm*—James D. Givnan, Jr.

[57] ABSTRACT

A stand for potted plants includes a tubular member for placement on a free standing post with base. Arms of rod stock are carried by the tubular member and are shaped to support and confine in place a centrally located potted plant. Hooks at the arm ends receive the bails of other potted plants. The arms are inclined downwardly and outwardly and carry their respective plants offset below the centrally located plant and contribute toward stability of the stand.

3 Claims, 1 Drawing Sheet

FIG

STAND FOR POTTED PLANTS

BACKGROUND OF THE INVENTION

The present invention pertains generally to stands on which two or more potted plants may be supported for display purposes. Potted plants are commonly used about homes and other structures to enhance their appearance and impart visual pleasure to the resident or passersby. Commonly large potted plants for outdoor use are sold with wire hangers to permit suspension of the potted plant from an overhead support, for example, the eave of a roof, a driveway light, etc. Accordingly the plants are necessarily located not by choice but rather by the location of existing structures to hang same from.

The prior art does show various structures for supporting multiple potted plants on a single support, such being disclosed in U.S. Pat. No. 4,194,319 shows various sized pots for plants supported on horizontal tubular frame members of an umbrella-like structure. U.S. Pat. No. 4,757,641 discloses an assembly with several horizontal arms each terminating in a pot supporting ring intended for obscuring the exposed end of a well casing to which the arms are clamped by a cap screwed in place on the casing. U.S. Pat. No. 4,083,457 discloses a bracket with multiple rings for reception of potted plants with provision for screwed attachment of the bracket to a supporting post or pole. The plants so supported are grouped in pairs and located adjacent the post or pole. U.S. Pat. No. 4,583,323 shows a plant holder with horizontal arms 6 terminating in hooks 28 for hanging basket planters.

SUMMARY OF THE PRESENT INVENTION

The present invention is embodied within a stand enabling the display of several potted plants in an economical and attractive manner without reliance on an overhead support or supports.

The present stand includes multiple radiating arms each adapted to support at least one potted plant at a distal arm end with the arms carried by a tubular support member adapted for engagement with a free standing post. Uppermost portions of the arms are configured to define an area in which may be received a centrally located potted plant which may be viewed in an unobstructed manner as the plant is not suspended from an overhead support by a wire hanger. The tubular support member of the stand may be conveniently embodied in a box beam segment with an orthogonal cross section which seats about the upper end of a post of the stand. A base supports the post in a stable manner.

Important objectives of the present invention include the provision of a stand for potted plants with provision for several plants displayed at one level above a ground surface and a centrally located elevated potted plant displayed in the manner of being on a pedestal; the provision of a stand for potted plants which includes a weldment of rods and a centrally disposed box beam member with the latter adapted for placement about the upper end of a post to greatly simplify stand assembly by the purchaser as such assembly may be accomplished without hand tools; the provision of a stand for potted plants wherein arm members, in addition to each supporting a potted plant, serve to confine a centrally disposed potted plant in place against all but intentional removal; the provision of a stand of stable construction for potted plants and utilizing low cost components which lend themselves to convenient assembly.

DETAILED DESCRIPTION OF THE PREFERRED EMBODIMENTS

Figures 1, 2, 3:
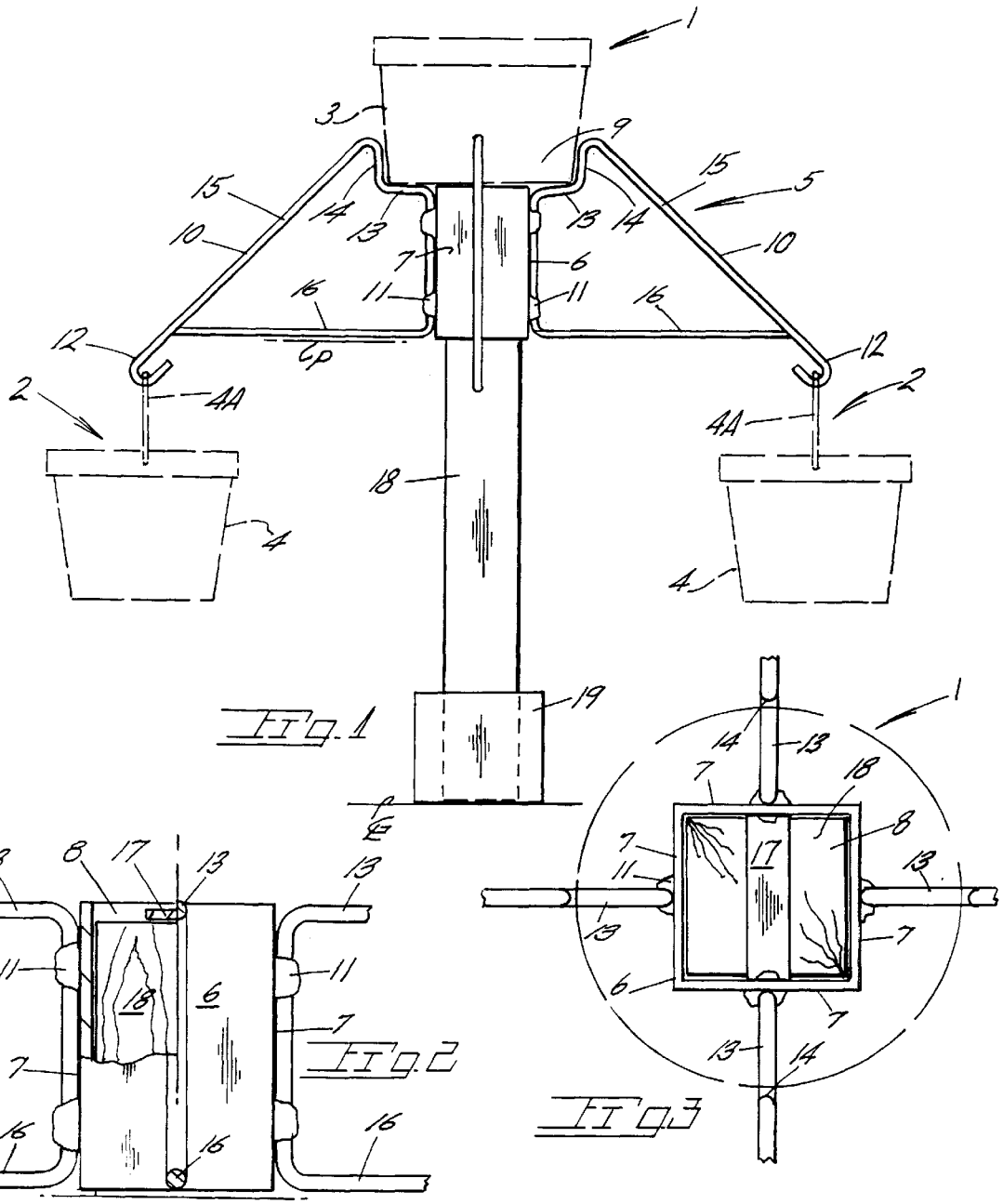
FIG. 1 is an elevational view of the present stand for potted plants.
FIG. 2 is an enlarged elevational view of a fragment of a weldment of the present stand.
FIG. 3 is a partial plan view of the stand.

With continuing attention to the drawing, wherein applied reference numerals indicate parts similarly hereinafter identified, the reference numeral 1 indicates a centrally located potted plant while additional potted plants at 2 are disposed in a radial direction about plant 1. Pots for the plants are indicated at 3 and 4.

A potted plant holder is indicated generally at 5 and includes a tabular member 6 having walls 7 which define an interior or open area at 8. Arms as at 10 are each carried by a wall 7 and affixed thereto as by welds 11. The arms are preferably formed from shaped metal rods each with a hook 12 at its distal end for the retention of a bail 4A of a plant pot 4. Arm angular segments at 13 and 14 are respectively generally horizontal and vertical to jointly define an upwardly opening area 9 to receive and confine pot 3 of centrally located plant 1. An inclined arm segment 15 of each arm extends downwardly and outwardly relative tubular member 6 and terminates in hook 12 while a brace portion at 16 of the arm supports inclined segment 15. A plate 17, within tubular member 6, serves to limit downward placement of cap 6 on a post 18 which has its lower end inserted within a base 19 which preferably is a concrete block or other body of adequate mass to impart stability to the present stand. Utilization of a concrete block or other base permits the stand to be positioned on a deck or patio as the user sees fit. The tubular member 6, being in rested placement on post 18, additionally permits ready disassembly of the hanger components for purposes of convenient storage during the winter months.

Retainer 12, shown preferably as hooks, may be otherwise formed, as for example, as rings. While a limit stop plate 17 is shown inside tubular member or cap 6, if so desired, engagement of the tubular member with post 18 may be limited otherwise as by a post engaged fastener leaving the interior of tubular member 6 unobstructed for positioning along post 18. Still further tubular member 6 may be of other than polygonal section. For stability of the stand it is preferred that the retainers 12, from which pots 4 are suspended, are located proximate a horizontal plane P containing the lower extremity of tubular member or cap 6.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

I claim:

1. A stand for potted plants comprising, a post adapted for upright placement relative a ground surface, a tubular member having multiple walls in place about an upper end segment of said post, and arm members secured one each to said walls of the tubular member and each having horizontal and vertical segments jointly defining an upwardly opening area above said tubular member for receiving a potted plant, said arm members having retainers at their respective distal ends for retention of a potted plant, said retainers on each of said arm members located proximate a horizontal plane containing the lower extremity of said tubular member to contribute to the stability of the stand.

2. In a plant stand including a post for supporting potted plants, the improvement comprising, a tubular member of rectangular cross section having multiple orthogonal walls for placement about the post, arm members each having inclined segments projecting radially from the tubular member, each of said inclined segments terminating in retainer means for supporting engagement with one of said potted plants, said retainer means located proximate a horizontal plane containing the lower extremity of said tubular member to contribute to the stability of the plant stand, and said arm members each additionally having horizontal and vertical segments jointly defining an area above said tubular member in which one of said potted plants may be received.

3. The improvement claimed in claim 2 wherein said tubular member includes a limit stop plate located crosswise of the tubular member for rested engagement with the post of the stand.

* * * * *